United States Patent [19]

Graef et al.

[11] Patent Number: 4,664,369

[45] Date of Patent: May 12, 1987

[54] MULTIPLE SHEET INDICATOR APPARATUS AND METHOD

[75] Inventors: Harry T. Graef; Kevin H. Newton, both of Stark County, Ohio

[73] Assignee: Diebold Incorporated, Canton, Ohio

[21] Appl. No.: 782,350

[22] Filed: Oct. 1, 1985

[51] Int. Cl.[4] ..... B65H 7/12

[52] U.S. Cl. ..... 271/263; 209/603; 209/604

[58] Field of Search ..... 271/262, 263; 209/600, 209/601, 603, 604

[56] References Cited

U.S. PATENT DOCUMENTS

| | | | |
|---|---|---|---|
| 3,722,773 | 3/1973 | Plate et al. | 271/263 |
| 3,860,234 | 1/1975 | Parenti et al. | 271/263 |
| 4,378,109 | 3/1983 | Takahashi et al. | 271/263 |
| 4,420,150 | 12/1983 | Umezawa | 271/263 |
| 4,449,399 | 5/1984 | Hain | 209/604 X |
| 4,579,334 | 4/1986 | Durajczyk et al. | 209/604 X |

FOREIGN PATENT DOCUMENTS

| | | | |
|---|---|---|---|
| 183958 | 11/1963 | U.S.S.R. | 209/603 |
| 680769 | 8/1979 | U.S.S.R. | 209/604 |

*Primary Examiner*—Joseph J. Rolla
*Assistant Examiner*—Edward S. Ammeen
*Attorney, Agent, or Firm*—Ralph E. Jocke

[57] ABSTRACT

Thickness indicator apparatus mounted adjacent to a bill path inside an Automated Teller Machine (ATM) includes a wishbone (45) having a pair of identical fingers (46) which contact bills moving in the bill path, and a metallic target (52). The wishbone is floatably mounted to the frame of the ATM such that target (52) is displaced an amount which is proportional to the thickness of the bills in contact with fingers (46). A sensor (66) senses the position of the target (52) and generates an electrical signal indicative of bill thickness.

21 Claims, 15 Drawing Figures

MULTIPLE SHEET INDICATOR APPARATUS AND METHOD

TECHNICAL FIELD

The present invention relates to devices which process paper sheets and particularly to devices which dispense paper currency bills such as Automated Teller Machines (ATMs). The present invention relates to devices used in ATMs to indicate the thickness of sheets and to detect abnormal sheet conditions such as skewed sheets, overlapped multiple sheets, and folded sheets.

BACKGROUND ART

A number of devices have been previously used in currency dispensing machines to measure the thickness of the bills dispensed and to detect folded or overlapped bills. U.S. Pat. No. 4,154,437 owned by the assignee of the present invention discloses apparatus for detecting the presence of folded or overlapped sheets. This apparatus comprises a pair of adjacent cooperating rolls. The first roll of the pair is mounted on a relatively thick, rigid shaft. The second roll of the pair is mounted on a relatively thin, flexible shaft. The bills are passed between the rolls generally one at a time. As bills are passed between the rolls, the second roll which is mounted on the flexible shaft is deflected an amount proportional to the thickness of the bill. By sensing the deflection of the second roll, the thickness of the bill is determined. The apparatus disclosed in the patent averages thickness over the entire length of the bill. Averaging thickness avoids the rejection of bills which may be slightly thicker in portions than normal bills.

U.S. Pat. No. 4,462,587, also owned by the assignee of the present invention, utilizes similar thickness sensing apparatus. The invention disclosed in this patent however, involves a method for utilizing the thickness measurements obtained from the sensor to determine the particular status of the bills detected such as single bills, overlapped double bills, etc. According to the invention of this patent, once the condition of the bill(s) is identified the bill(s) are either dispensed or withheld from being dispensed depending on the number of bill(s) requested by the individual operating the currency dispensing machine or ATM.

The thickness indicating apparatus disclosed in both U.S. Pat. Nos. 4,154,437 and 4,462,587 has the inherent disadvantage that it senses thickness at only one location across the bill, normally along the center line of the bill path. Bills which are folded or skewed may fail to pass through the rolls which results in such bills being dispensed undetected. The cooperating pair of rolls require considerable space which limits where they can be positioned inside the bill dispensing apparatus. In addition, due to the high precision required of the components for the thickness sensing apparatus, it is expensive to manufacture.

Other types of thickness indicating apparatus have been previously used as thickness detectors. Photoelectric devices which determine bill thickness by measuring the amount of light which will pass through a bill and capacitance sensors which determine bill status based on the varying electrical characteristics of single/double bills, etc., have been previously utilized. These devices all have the same inherent disadvantage in that they sense thickness at only one location across the bill and miss certain skewed or folded bills. Such devices are also subject to failure due to build-up of dirt on the sensors, which occurs frequently when used currency is dispensed. A further drawback is that such devices are expensive. Because the amount of light transmitted as well as capacitance varies substantially between new and used bills, such devices are generally less reliable than mechanical sensors.

The problem of skewed or folded bills missing a thickness sensing apparatus is minimized when bills are transported lengthwise; that is with the short side leading as was the case with the bill transports shown in U.S. Pat. Nos. 4,154,437 and 4,462,587. The probability of a failure to detect a bill is increased when bills are transported laterally with the long side leading, as in such circumstances bills have a greater tendency to skew and fold during transport.

Thus there exists a need for a thickness indicator apparatus that detects the thickness of bills transported laterally in a transport path, which bills may be located in a plurality of locations across the width of a transport path; is less susceptible to failure to detect skewed or folded bills; operates in a limited space; is more reliable; and is less expensive than thickness sensing apparatus presently available.

DISCLOSURE OF INVENTION

It is an object of the present invention to provide sheet thickness indicating apparatus capable of simultaneously indicating the thickness of a sheet at a plurality of locations in a sheet path.

It is a further object of the present invention to provide thickness indicating apparatus which is capable of indicating the thickness of skewed or folded sheets.

It is a further object of the present invention to provide a currency bill thickness indicating apparatus which is compact and capable of measuring document thickness with very limited access to a bill path.

It is a further object of the present invention to provide a currency bill thickness indicating apparatus which is simple, reliable, and inexpensive.

Further objects of the present invention will be made apparent in the attached Description of the Best Modes for Carrying Out the Invention and the appended claims.

The foregoing objects are accomplished by a thickness indicator apparatus mounted adjacent to a bill path inside an ATM wherein the bills are transported one at a time from a supply of bills to a point of delivery. The thickness indicating apparatus comprises a wishbone which incorporates a pair of fingers which contact the surface of a bill as it is transported. The wishbone is floatably mounted to the frame of the ATM. The wishbone incorporates a movable surface or target arranged such that the position of the target is characteristic of the thickness of the bill contacted by the fingers. A position sensor senses the position of the target and generates an electrical signal indicative of bill thickness.

BEST MODES FOR CARRYING OUT INVENTION

Figure 1:
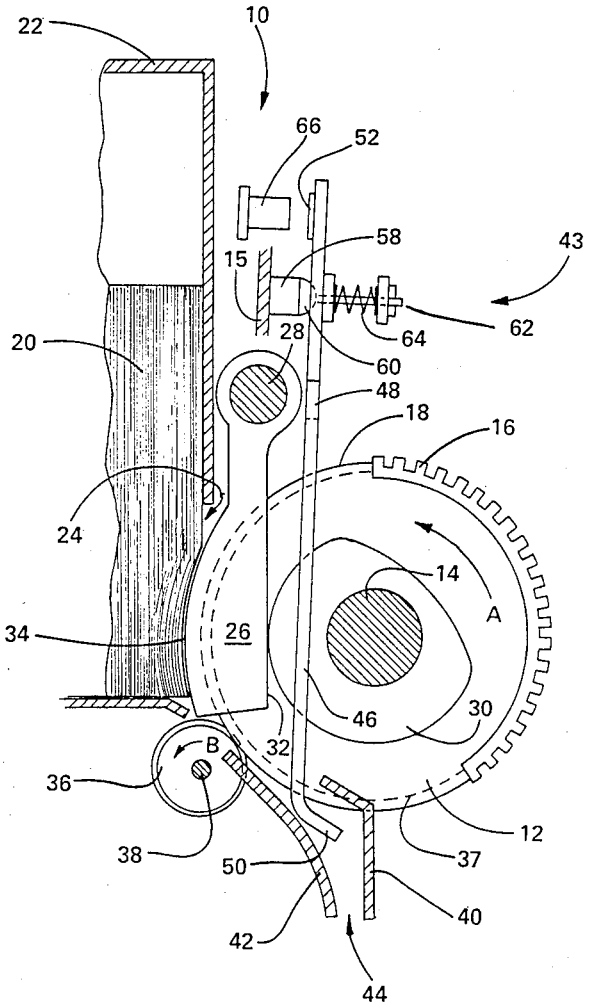
FIG. 1 is a sectioned side view of a paper currency bill dispensing mechanism incorporating the thickness indicator apparatus of the present invention and a canister containing currency.

The preferred embodiment of the present invention is used in conjunction with the paper currency dispenser friction picker mechanism disclosed in U.S. Pat. No. 4,494,747 assigned to the assignee of the present invention, which patent is incorporated by reference herein in its entirety. Portions of the friction picker mechanism are shown in the drawings. Those portions of the picker mechanism not essential to understanding the present invention have been deleted for purposes of brevity and clarity.

The preferred embodiment of the present invention is used according to the method disclosed in U.S. Pat. No. 4,462,587 entitled Method and System for Detecting Bill Status in a Paper Money Dispenser assigned to the assignee of the present invention and which patent is also incorporated herein by reference in its entirety.

Figure 3:
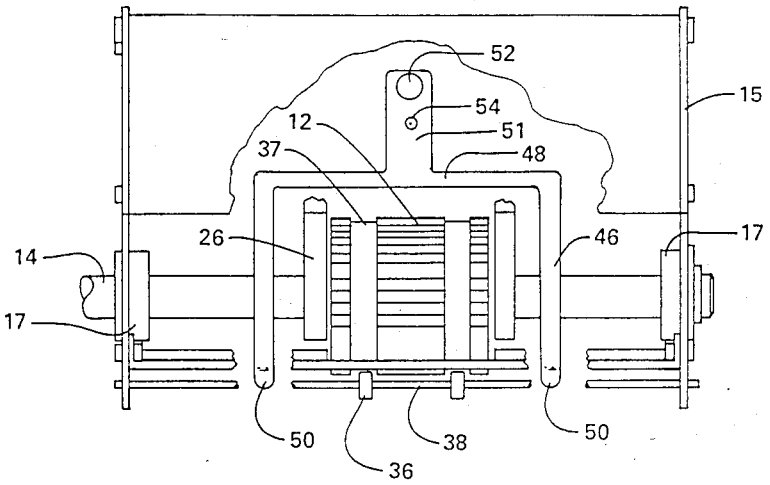
FIG. 3 is a partially sectioned front view of a paper currency dispensing mechanism incorporating the thickness indicator apparatus of the present invention.

Referring to the drawings and particularly to FIG. 1, there is shown a friction picker mechanism disclosed in U.S. Pat. No. 4,494,747 generally indicated at 10. The friction picker mechanism is comprised of a roller 12 which is mounted on a shaft 14. Picker 10 is enclosed in a frame 15 (see FIG. 3). Shaft 14 is mounted in frame 15 between bearing means 17. Shaft 14 is driven by a stepper motor (not shown) under the intelligent control of the computer which operates the ATM or other currency dispensing device which incorporates the picker mechanism. Roller 12 includes a high friction circumferential portion 16 and a low friction circumferential portion 18. Roller 12 includes a cam portion 30. A U-shaped lever 26 rides on cam 30 and moves in response thereto. Lever 26 is supported by a shaft 28 which is mounted to frame 15. Lever 26 is free to rotate on shaft 28 and lever 26 is held in contact by the inner face 32 to cam 30 by force application means (not shown).

A stack of currency bills 20 is located inside a currency canister 22 as shown in FIG. 1, during normal operation of the picker mechanism. Canister 22 includes an opening 24 adjacent to roller 12 and which is sized such that the circumference of roller 12 extends slightly into said opening. Stack 20 is held against opening 24 by force application means not shown. When cam 30 is in the position shown in FIG. 1, a forward face portion 34 on lever 26 extends through opening 24 and holds back stack 20 from contacting roller 12. Cam 30 is oriented on roller 12 such that face 34 of lever 26 holds back stack 20 except when high friction circumferential portion 16 is adjacent to stack 20. Roller 12 includes a pair of circumferential grooves 37. A pair of counter-rotating rollers 36 are mounted on a shaft 38. Shaft 38 is held in position in frame 15 by bearing means (not shown). Counter-rotating rollers 36 are mounted on shaft 38 such that their circumference extends into grooves 37 in roller 12. The outer surfaces of counter-rotating rollers 36 are in close proximity to, but do not contact roller 12. Counter-rotating rollers 36 are driven by drive means (not shown). During normal operation roller 12 rotates in the direction of Arrow A and counter-rotating rollers 36 rotate in the direction of Arrow B as shown in FIG. 1.

Two (2) plates 40 and 42 are mounted adjacent to roller 12 and are attached to frame 15 by mounting means (not shown). Plates 40 and 42 form an opening generally indicated at 44 through which bills are discharged to the customer operating the ATM.

Figure 2:
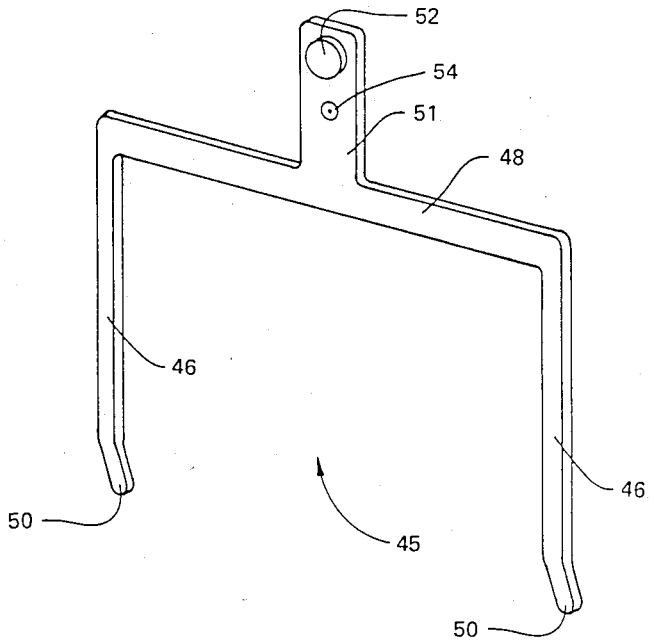
FIG. 2 is a perspective view of the wishbone portion of the preferred embodiment of the present invention.

The preferred embodiment of the bill thickness indicator apparatus of the present invention is generally indicated at 43. The apparatus includes a wishbone 45 (see FIG. 2). The wishbone includes two (2) identical fingers 46 extending from a body 48. Fingers 46 terminate in rounded faces 50. Body 48 also includes a centrally located post 51. A target 52 which in the preferred embodiment is a uniform circular disc of metallic material, is mounted on post 51 by fastening means so as to be integral therewith. Body 48 also incorporates counter-sunk hole 54. Wishbone 45 is preferably made of rigid plastic material.

Wishbone 45 is mounted to the frame 15 of the friction picker mechanism on a pin 58. Pin 58 has a hemispherical head portion 60 which is accepted into counter sunk hole 54 of wishbone 45. A rod 62 extends from the top of head portion 60 and through hole 54. The diameter of rod 62 is smaller than hole 54 so as not to restrict small angular movements of the wishbone. The wishbone 45 is held in contact with head 60 by spring-loaded locking means 64. Thus, wishbone 45 is floatably mounted to frame 15 by pin 58 as the wishbone is free to rotate about the pin in two (2) planes.

A proximity sensor 66 is mounted to frame 15 adjacent to target 52 by fastening means (not shown). Proximity sensor 66 acts a signal generating means and is preferably of the type which generates a voltage signal proportional to the distance of the plane of the face of the metallic target 52 from the sensor such as a Model No. 725744 manufactured by Electro Corporation of Sarasota, Florida. Force application means (not shown) hold wishbone 45 in position such that rounded ends 50 of fingers 46 are held in contact with plate 42. This "no bill" condition is a point of reference from which bill thickness is measured as will be hereafter explained.

Figure 4:
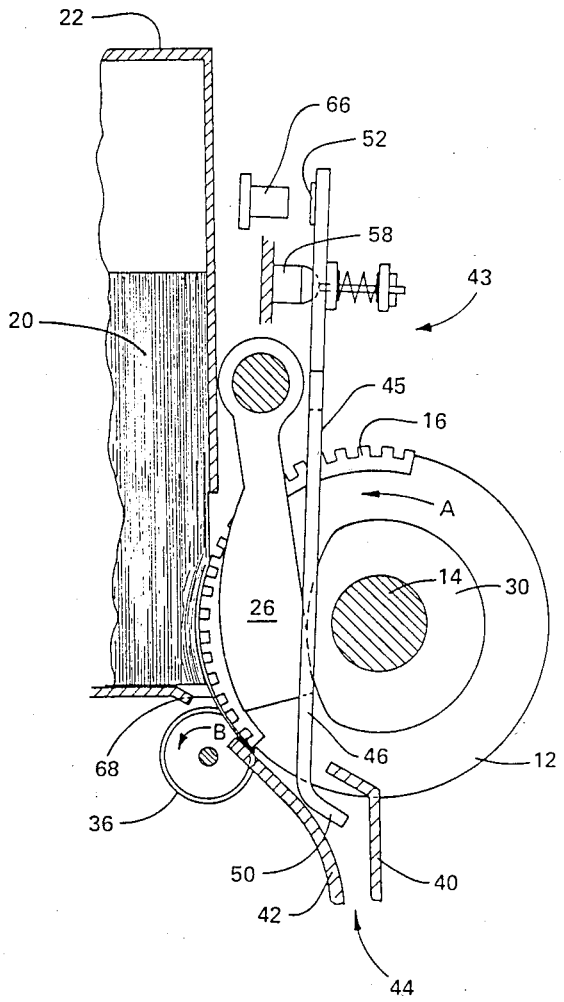
FIGS. 4 and 5 are sectioned side views of a paper currency dispenser mechanism and the thickness indicator apparatus of the present invention at various stages of the operating cycle of the dispenser mechanism.

During operation of the picking mechanism, roller 12 rotates in the direction of Arrow A and counter-rotating roller 36 rotates in the direction of Arrow B as shown in FIG. 4. As the high friction portion 16 of roller 12 approaches stack 20, the rotation of cam 30 causes lever 26 to retract. The retraction of lever 26 moves forward face 34 out of canister 22. This allows stack 20 to move towards roller 12. High friction portion 16 then contacts the stack and the rotation of roller 12 pulls a first bill 68 downward off the stack. Further rotation of roller 12 pulls first bill 68 into the nip between roller 12 and counter-rotating roller 36. The action of counter-rotating rollers 36 strips any additional bills that may have been pulled off the stack with first bill 68. Because high friction portion 16 has a greater surface area than counter-rotating roller 36, further rotation of roller 12 pulls bill 68 through the nip created by roller 12 and counter-rotating roller 36 (see FIG. 5). Further movement of roller 12 causes bill 68 to contact rounded faces 50 of fingers 46. Fingers 46 direct the leading edge of the bill between rounded faces 50 and plate 42, causing fingers 46 to be displaced and causing wishbone 45 to rotate about pin 58. Further movement of roller 12 causes the leading edge of bill 68 to contact plate 40, which directs it downward through opening 44.

Figure 5:
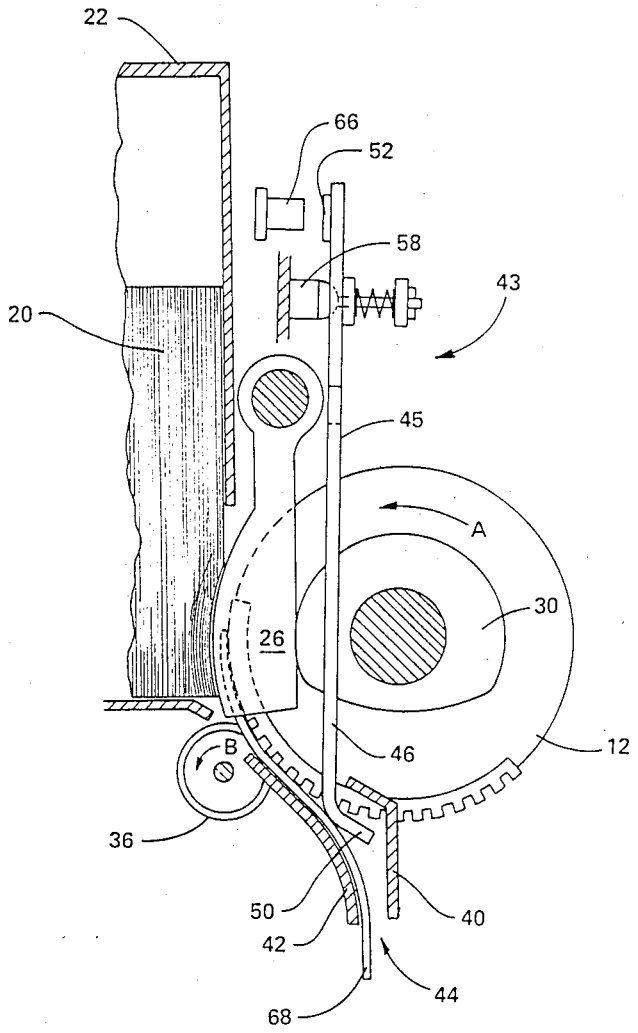

Fingers 46 act as sensor means for sensing the thickness of bill 68 between rounded faces 50 of fingers 46 and plate 42. The thickness of bill 68 displaces wishbone 45 and causes it to rotate about pin 58 in the counter clockwise direction as shown in FIG. 5. The rotation of wishbone 45 causes the target 52 to move closer to sensor 66. Sensor 66 serves as a sensor means sensing the position of the target and signal generating means producing a signal indicative of the distance from the sensor to the target. Thus the signal produced by sensor 66 is characteristic of the thickness of bill 68 between plate 42 and fingers 46.

Normally bills are pulled downward from stack 20 by roller 12 uniformly and with the lateral edges of the bill parallel to the center line of shaft 18. Occasionally, however, bills will be pulled from stack 20, skewed at an angle, with one corner leading the other. As fingers 46 contact a bill in a plurality of locations in a line across the bill, it is not susceptible to missing bills which may be severely skewed to one side of the bill path. In the preferred embodiment of the invention the use of two (2) identical fingers spaced apart at their center lines by approximately 6.0 cm centrally and symmetrically positioned in the bill path is sufficient to contact even the most highly skewed bills. For other embodiments it may be desirable to utilize more than two (2) fingers or other arrangements to insure that all sheets which may be transported past the thickness sensing apparatus are detected.

Figure 6:
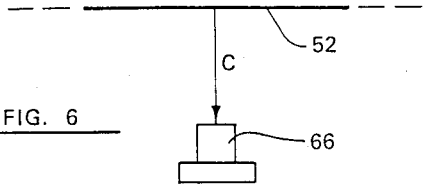
FIGS. 6 through 11 show the relative positions of the target and the position sensor of the preferred embodiment of the present invention for various bill thickness conditions.
Figure 7:
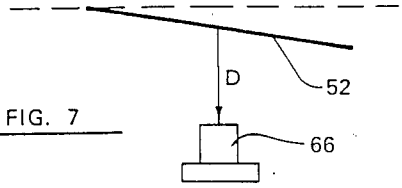

FIGS. 6 through 11 show relative positions of target 52 and sensor 66 for various bill thicknesses. FIG. 6 shows the face of target 52 in the position when no bill is present between plate 42 and either of fingers 46. For this condition, the distance from the face of target 52 to the face of sensor 66 is indicated by Arrow C. In FIG. 7 target 52 is shown for the condition in which one (1) bill thickness is under one (1) of the fingers 46 but not the other. This condition occurs when a bill is removed from the stack skewed such that one side of the bill is being pulled along by roller 12 ahead of the other. For this condition the distance from the center of target 52 to the face of sensor 66 is indicated by Arrow D. As all United States currency bills have a thickness which lies within a narrow range, the distance wishbone 45 will be displaced by the presence of one (1) bill under one (1) of the pair of fingers 46 is within a narrow range which approximates a fixed quantity. Thus, the length of Arrow D shown in FIG. 7 is less than Arrow C in FIG. 6 by a fixed amount. Further, the symmetrical arrangement of fingers 46 on wishbone 45 causes the length of Arrow D to be the same regardless of which of the pair of fingers a bill may be located under. Therefore whenever a bill is under one (1) finger 46 but not the other, the signal produced by sensor 66 will be approximately the same value.

Figure 8:
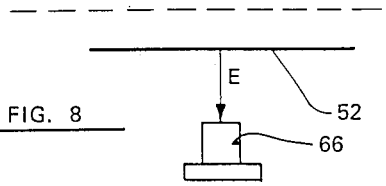
Figure 9:
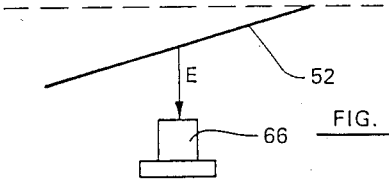

In FIG. 8 target 52 is shown with one (1) bill thickness under both the fingers 46. For this condition the distance from the center of target 52 to sensor 66 is indicated by Arrow E. The length of Arrow E is always approximately the same whenever a single bill thickness is under both fingers 46 and therefore the magnitude of the signal generated by sensor 66 is a fixed value for this condition.

In the event double bills are pulled from stack 20 overlapped and in a skewed position, and the second bill is not stripped by the action of counter-rotating rollers 36, a double bill thickness may be present under one (1) of the fingers 46 while no bill is present under the other. For this condition the distance from the face of target 52 to the the face of sensor 66 will be the same as that for a single bill under both fingers 46 (see FIG. 9).

Figure 10:
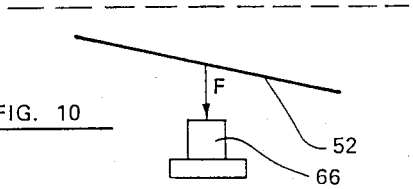
Figure 11:
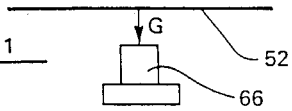

FIG. 10 shows the position of target 52 and sensor 66 when two (2) bill thicknesses are under one (1) of the pair of fingers 46 while only one (1) bill thickness is under the other. For this condition the distance from the target to the sensor is indicated by Arrow F. Likewise in FIG. 11 the position of the target is shown for the condition where two (2) bill thicknesses are under each of the pair of fingers 46. For this condition the distance from the target to the sensor is shown by Arrow G.

As the lengths of Arrow C, D, E, F, and G are all characteristic of specific bill conditions, each produces a unique signal from sensor 66. Therefore, the existence of each of these conditions is identifiable through the use of known apparatus and methods for the analysis of electrical signals. The signals from sensor 66 which vary continuously with the distance from target 52 to sensor 66 are transformed into discrete bill condition signals. A first signal is generated whenever the electrical signal from sensor 66 corresponds to at least the one-half ($\frac{1}{2}$) bill thickness condition shown in FIG. 7. A second electrical signal is generated (along with the first signal) whenever the one bill thickness condition of FIG. 8 exists. A third signal in addition to the first two is generated whenever the signal corresponds to the one and a half ($1\frac{1}{2}$) bill condition of FIG. 10 and so on. The generation of these discrete signals is accomplished according to the preferred embodiment through the use of a programmable read only memory micro computer chip which is programmed to analyze the output of sensor 66 and to generate the discrete signals in response thereto. The thickness indicator apparatus of the present invention produces signals which are analyzed in the preferred embodiment in the same manner as the signals generated by the bill thickness apparatus in U.S. Pat. No. 4,462,587 except in the present application discrete signals are additionally produced for the presence of one-half ($\frac{1}{2}$) bill thicknesses.

The nature of the bills being dispensed can be determined using the preferred embodiment thickness indicator apparatus and the method for calculating the character of dispensed bills disclosed in U.S. Pat. No. 4,462,587. The analysis is carried out as the bills are moved past fingers 46. The nature of the bills is susceptible to analysis because the bills move downward from the stack in contact with, and at the same speed as the circumference of the high friction portion 16 of roller 12. As roller 12 is driven by a stepper motor which rotates in discrete angular steps of known magnitude under the intelligent control of the computer operating the ATM, the lineal distance the bill moves is known. As the thickness indicator apparatus of the present invention generates signals which are convertible into the discrete bill thickness signals, the duration of such signals can be combined by the computer with the bill length over which they were generated to determine the exact character of each bill.

According to one method of analyzing these signals, only the signal corresponding to one (1) bill thickness is used by the computer system to control the dispense. The presence of the one-half (½) bill signal without the one (1) bill signal, or any signal indicative of a bill thickness greater than one (1) bill serve only to indicate to the computer that a skewed, folded, or other unusual bill has been picked. Because in the preferred embodiment fingers 46 sense the thickness of the leading edge of the bill prior to the lagging end of the bill losing contact with roller 12, any multiple or skewed bills can be pulled back into stack 20 by reversing the rotation of roller 12. This is accomplished by the computer controlling the operation of the ATM by reversing the direction of the stepper motor, which drives shaft 14. Once the bills are pulled back past the nip created by roller 12 and counter-rotating rollers 36, the computer recommences rotation of roller 12 in the direction of Arrow A. This process of reversing the rotation of roller 12 causes a "scrubbing" action which tends to separate multiple bills and square the direction of travel of single bills so that they will contact fingers 46 simultaneously. The "scrubbing" process is repeated until bills are separated and properly aligned.

Figure 12:
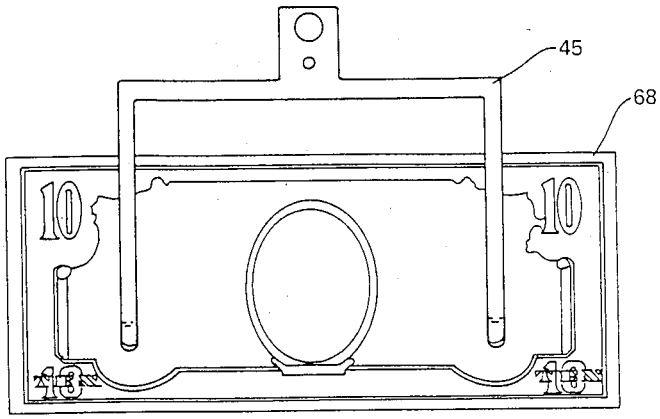
FIGS. 12 and 14 show a paper currency bill in position to be detected by the thickness indicator apparatus of the preferred embodiment of the present invention.
Figure 13:
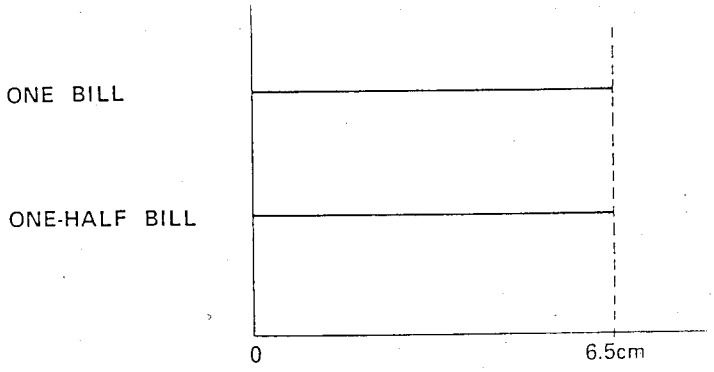
FIGS. 13 and 15 show electrical signals generated by the passage of the bills oriented as shown in FIGS. 12 and 14 respectively, past the thickness indicator apparatus of the preferred embodiment of the present invention.

In FIG. 12 a normal single bill 68 is shown under wishbone 45. The signals generated during the passage of a single bill having this orientation are shown in FIG. 13. As the bill is square, both the one (1) bill and one-half (½) bill signals are generated for an identical period as roller 12 rotates through an angle which translates into the lineal distance of the width of a single bill which is approximately 6.5 cm. The computer controlling the operation of the ATM calculates the lineal distance of the bills over which the signals are generated. The lineal distance for each step of the motor is a constant factor equal to the angular rotation of roller 12 for said step (in radians) multiplied by the radius of high friction circumferential portion 16. Thus, the lineal distance traveled by a bill in contact with fingers 46 is calculated as the product of the number of steps the motor is directed by the computer to take and the lineal distance factor for each step.

Figure 14:
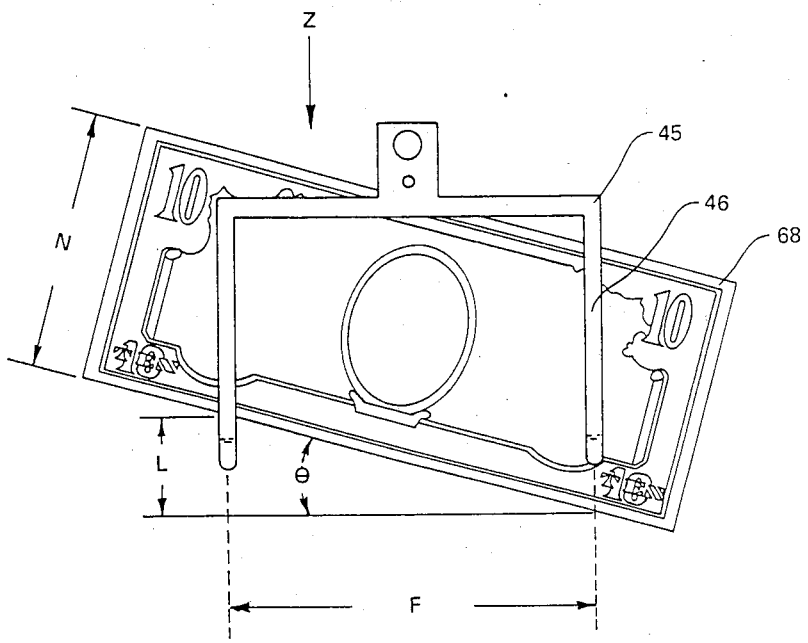
Figure 15:
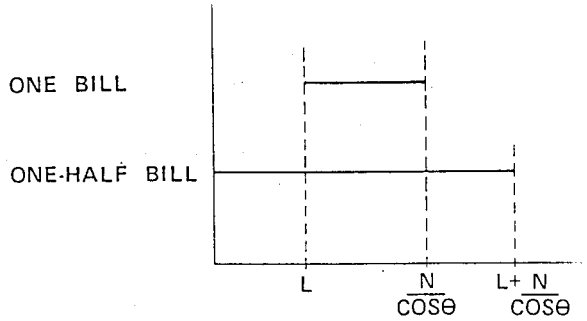

A second method for utilization of the preferred embodiment of the thickness indicator apparatus allows skewed and double bills to be analyzed. According to this method, the computer controlling the operation of the ATM calculates the angle at which bills are skewed; and if the skewed bills are identifiable and not in excess of the amount requested, dispenses them to the customer operating the ATM without attempting to reorient them by "scrubbing". In FIG. 14 a bill 68 is shown skewed relative to wishbone 45 at an angle $\theta$. The bill is moved in the lineal direction of Arrow Z in FIG. 14 by the rotational movement of roller 12. As fingers 46 are identical, the finger located on the right in FIG. 14 contacts the bill prior to the finger on the left,; thus causing a one-half (½) bill thickness signal to be generated over a distance prior to the commencement of a one (1) bill thickness signal being generated. The relationship of these two (2) signals are shown in FIG. 15. The distance traveled by the bill between the generation of the one-half (½) thickness signal and the one (1) bill thickness signal is calculated by the computer by counting the number of steps the motor takes between the generation of said signals, and multiplying the number of steps by the lineal distance factor representative of the bill length per step. As the distance by which the one-half (½) bill signal precedes the one (1) bill signal (L) is known from the rotation of roller 12 and the distance between a pair of fingers 46 (F) is fixed, the angle $\theta$ can be calculated by the computer according to the following formula:

$$\theta = \text{Tan.}^{-1} \frac{(L)}{(F)}$$

The width of all U.S. currency bills is within a very narrow range of a fixed value (N). Therefore, once the angle $\theta$ is determined, the longitudinal distance across the width of the bill skewed at angle $\theta$ can be calculated as follows:

$$\text{Horizontal Distance Across Skewed Bill} = \frac{N}{\text{Cos. } \theta}$$

This horizontal distance across the skewed bill in the direction of transport will generally be sensed by both fingers 46. In addition, a one-half (½) bill signal will exist for the same distance beyond the one (1) bill signal as the one-half (½) bill signal preceded the one (1) bill signal. Although according to the preferred embodiment of the invention, when the trailing edge of the bill passes fingers 46 it is too late to recapture the bill by reversing the direction of roller A, the symmetry of the signals can be utilized to verify that a proper dispense has occurred or an error has been committed. The computer controlling the operation of the ATM is programmed to calculate the angle $\theta$ and to check the symmetry of the one-half (½) bill signal to show that the bill is uniformly skewed. However, the computer is also programmed so that in the event a bill is not identifiable, attempts are made to scrub the bill to reorient it. Upon failing to make the bill identifiable after a preset number of attempts, the computer dispenses the bill and a fault condition is indicated. This prevents the dispenser from being rendered inoperable by a single skewed or overlapped bill. In order to avoid the dispense of such bills, the ATM may include a device which retrieves the bills from opening 44 rather than allowing them to be presented to the customer.

Overlapped and multiple skewed bills can be analyzed using the second method for utilizing the preferred embodiment of the present invention. This analysis is carried out by the computer controlling the operation of the ATM according to the method described in U.S. Pat. No. 4,462,587. However, in the case of the present invention, the standard length of a bill (N) stored in the computer and used for analysis must be adjusted for the angle $\theta$ according to the formula for calculating the horizontal distance across a skewed bill mentioned above. Additionally the computer is programmed to compare the angle of any bill partially overlapping a preceding bill to the angle of the preceding bill; and in the event such angles are not identical, to initiate a "scrubbing" operation.

Thus the new multiple sheet indicator apparatus and method achieves the above-stated objectives, eliminates difficulties encountered in the use of prior devices, solves problems, and obtains the desired results described herein.

In the foregoing description certain terms have been used for brevity, clarity, and understanding. However, no unnecessary limitations are to be implied therefrom; because such terms are used for descriptive purposes and are intended to be broadly construed. Moreover, the description and illustrations given are by way of an example and the invention is not limited to the exact details shown or described.

Having described the features, discoveries, and principals of the invention, the manner in which it is utilized, and the advantages and useful results obtained, the new and useful structures, devices, elements, arrangements, parts, combinations, systems, equipment, operations, methods and relationships are set forth in the appended Claims.

We claim:

1. Apparatus for indicating the thickness of sheets moving in a sheet path, which sheets may be overlapped, skewed, or folded, comprising:

a plurality of fingers which contact said sheets in a plurality of locations in the sheet path;

a body interconnecting said fingers;

a target surface plane responsive to the sheet thicknesses contacted by each of said plurality of fingers, said plane exhibiting a displacement from a reference position indicative of the thicknesses contacted by each of said fingers; and signal generating means generating signals according to the displacement of said plane.

2. The apparatus according to claim 1 wherein the target surface plane is integral with said body.

3. The apparatus according to claim 2 wherein the fingers are arranged to contact the sheets in a single line perpendicular to the direction of sheet movement in the sheet path.

4. The apparatus according to claim 3 and further comprising a frame and mounting means mounting said body on said frame, said mounting means enabling movement of said fingers in a direction of sheet thickness and rotation of said fingers about an axis parallel to the direction of sheet travel.

5. The apparatus according to claim 4 wherein the signal generating means is a distance sensor producing a signal the magnitude of which is indicative of the distance from the sensor to the target surface plane.

6. The apparatus according to claim 5 wherein the fingers are identical and arranged symmetrically about the body.

7. The apparatus according to claim 6 wherein the body is mounted such that the fingers are symmetrical about the center line of the sheet path.

8. The apparatus according to claim 1 wherein the number of fingers is two (2).

9. The apparatus according to claim 8 wherein the sheets are currency bills.

10. Apparatus for indicating the thickness of sheets moving in a sheet path, which sheets may be overlapped, skewed or folded, comprising:

a plurality of fingers contacting said sheets;

a frame;

mounting means mounting and fingers for movement on said frame, each of said fingers independently displaceable in a direction of sheet thickness;

a target surface plane in operative connection with said fingers, said target surface plane positioned according to the displacements of said fingers; and signal generating means for generating signals indicative of the position of said target surface plane.

11. The apparatus according to claim 10 and further comprising a body connecting said fingers and said target surface plane.

12. The apparatus according to claim 11 wherein asid fingers are a pair of spaced fingers traverse of the direction of sheet movement in the sheet path.

13. The apparatus according to claim 11 wherein said mounting means comprises a pin mounted on said frame, said pin including a head portion, a recess in said body accepting the head portion and enabling rotation of the head portion therein, and biasing means biasing said head portion and body adjacent.

14. A method for dispensing sheets individually from a sheet dispensing machine, in which machine a plurality of sheets generally travel individually and aligned in a sheet path to a sheet dispensing station, but which sheets may be skewed or overlapped with other sheets, comprising the steps of:

moving said sheets in a first direction in the sheet path;

applying to said sheets a means for separating and aligning said sheets;

sensing sheet thickness at a plurality of locations traverse of the sheet path;

generating a first signal indicative of the thickness sensed at each of said locations;

comparing said first signal to a reference signal, said signals having a predetermined relationship when a sheet is aligned in the sheet path and not overlapped with said other sheets;

delivering said sheet to the sheet dispensing station in response to said signals having the predetermined relationship;

moving said sheets in a second direction in the sheet path opposite said first direction beyond said separating and aligning means in response to said signals not having the predetermined relationship;

whereby said method steps are repeated until said sheet is delivered at the sheet dispersing station.

15. A method for identifying a sheet as a regular single sheet for dispense from a sheet dispensing machine which sheet may be skewed, said sheet having a width and a thickness, comprising the steps of:

moving said sheet on movement means in a sheet path;

sensing sheet thickness at a first location and a second location traverse of the sheet path, said first and second locations spaced a first distance;

generating a first signal in response to sensing said sheet thickness at one of said locations and generating a second signal in response to sensing said sheet thickness at both of said locations;

measuring a second distance traveled by said movement means between first generation of said first signal and first generation of said second signal; calculating from said first and second distances an angle said sheet is skewed in the sheet path;

calculating a third distance from said width and said angle, over which said second signal is expected to be generated;

measuring a fourth distance traveled by said movement means over which said second signal is generated; and comparing said fourth distance to said third distance, whereby said sheet is identified when said third and fourth distances are equal.

16. The method according to claim 15 and further comprising the steps of:

measuring with measuring means a fifth distance traveled by said movement means between termination of said second signal and termination of said first signal; and comparing with comparing means said fifth distance to said second distance, whereby the identify of said sheet is verified when said second and fifth distances are equal.

17. A method for identifying first and second sheets as regular sheets for dispense together from a sheet dispensing machine which sheets are skewed, overlapped, or continguous, said sheet having a uniform width and uniform thickness, comprising the steps of:

moving said sheets on movement means in a sheet path;

sensing sheet thickness at a first location and a second location traverse of the sheet path, said first and second locations spaced a first distance;

generating a first signal in response to sensing a single sheet thickness at oen of said locations, a second signal in response to sensing said single sheet thickness at both of asid locations, a third signal in response to sensing as double sheet thickness at one of said locations and said single sheet thickness at the other of said locations, and a fourth signal in response to sensing said double sheet thickness at both of said locations;

measuring a second distance traveled by said movement means between first generation of said first signal and first generation of said second signal;

calculating from said first and second distances, a first angle said first sheet is skewed in said sheet path;

measuring a third distance traveled by said movement means between first generation of said second and third signals;

measuring a fourth distance traveled by said movemnet means between first generation of said third and fourth signals;

calculating from said first and fourth distances a second angle which said second sheet is skewed in the sheet path;

calculating from said first angle said third distance and said second angle, a fifth distance over which said second signal is expected to be generated and a sixth distance over which said fourth signal is expected to be generated;

measuring a seventh distance traveled by said movement means over which said second signal is generated and an eighth distance traveled by said movement means over which said fourth signal is generated;

comparing with comparing means said fifth and seventh distances and said sixth and eighth distances, whereby said sheets are identified when said compared distances are equal.

18. The method according to claim 17 and further comprising the steps of:

measuring a ninth distance traveled by said movement means between termination of said fourth signal and termination of said third signal; and comparing with comparing means said ninth distance to said fourth distance, whereby the identify of said sheets is verified when said ninth and fourth distances are equal.

19. The method according to claim 18 and further comprising the steps of:

measuring with measuring means a tenth distance traveled by said movement means between termination of said third signal and termination of said second signal; and comapring with comparing means said tenth distance to said third distance, whereby the identify of said sheets is verified when said tenth and third distances are equal.

20. The method according to claim 19 and further comprising the steps of:

measuring with measuring means an eleventh distance traveled by said movement means between termination of said second signal and termination of said first signal; and comparing with comparing means said eleventh distance to said second distance, whereby the identity of said sheets is verified when said eleventh distance and second distance are equal.

21. The method according to claim 19 wherein said second signal is generated in response to sensing said double sheet thickness at one of said locations and no thickness at the other of said locations.

* * * * *